United States Patent [19]

Newman

[11] Patent Number: 4,940,095

[45] Date of Patent: Jul. 10, 1990

[54] DEPLOYMENT/RETRIEVAL METHOD AND APPARATUS FOR WELL TOOLS USED WITH COILED TUBING

[75] Inventor: Kenneth R. Newman, Richmond, Tex.

[73] Assignee: Dowell Schlumberger Incorporated, Tulsa, Okla.

[21] Appl. No.: 303,592

[22] Filed: Jan. 27, 1989

[51] Int. Cl.[5] ..... E21B 33/068; E21B 23/00

[52] U.S. Cl. ..... 166/378; 166/77; 166/379; 166/387

[58] Field of Search ..... 166/77, 378–381, 166/384, 387

[56] References Cited

U.S. PATENT DOCUMENTS

| | | | |
|---|---|---|---|
| 2,758,654 | 8/1956 | Simmons | 166/77 |
| 3,373,818 | 3/1968 | Rike et al. | 166/77 |
| 3,841,407 | 10/1974 | Bozeman | 166/77 |
| 4,091,867 | 5/1978 | Shannon, Jr. et al. | 166/77 |
| 4,585,061 | 4/1986 | Lyons, Jr. et al. | 166/77 |
| 4,621,403 | 11/1986 | Babb et al. | 166/77 |
| 4,682,657 | 7/1987 | Crawford | 166/77 |

*Primary Examiner*—Bruce M. Kisliuk
*Attorney, Agent, or Firm*—Stephen A. Littlefield

[57] ABSTRACT

A method of inserting a well service tool for operating a coiled tubing which avoids the high and/or remote mounting of the heavy coiled tubing injector drive mechanism is disclosed. The method comprises assembling the well service tool within a closed end lubricator, mounting the lubricator or the wellhead and lowering the tool into the wellbore to a distance whereby at least a portion of the tool is adjacent the pipe rams of the wellhead. The pipe rams are then closed against the tool to effect a fluid tight seal and to hold the tool in position within the wellhead. The lubricator is then removed and the coiled tubing and injector drive mechanism are connected to the tool and wellhead, respectively. The pipe rams can then be released and normal coiled tubing operations carried out. The method offers the additional safety advantage of permitting pressure testing at each stage of the insertion process. Retrieval of the tool can be effected merely by reversing the process.

5 Claims, 2 Drawing Sheets

DEPLOYMENT/RETRIEVAL METHOD AND APPARATUS FOR WELL TOOLS USED WITH COILED TUBING

This invention relates to the art of production of subterranean fluids from a wellbore and, more particularly, to a method and apparatus for conducting various well evaluation and treatment operations utilizing coiled tubing.

BACKGROUND OF THE INVENTION

The use of coiled tubing for various well treatment processes such as fracturing, acidizing and gravel packing is well-known. The advantages in the use of coiled tubing include relatively easy and quick entry into a well without the necessity of employing complex and costly apparatus such as a workover derrick and the insertion of a tubing string into the well which is made up of a plurality of short lengths of tubing and which must be individually joined together.

Typically, several thousand feet of tubing is coiled onto a large reel which is mounted on a truck or skid. A coiled tubing injector head, typically employing chain-track drive, is mounted axially above the wellhead and the coiled tubing is fed to the injector for insertion into the well. The coiled tubing is plastically deformed as it is payed out from the reel and over a gooseneck guide which positions the coiled tubing along the axis of the wellbore and the injector drive mechanism.

Tools used with coiled tubing generally comprise a long ridged element having a central bore which, when attached to the coiled tubing, allows fluid communication between the bore of the coiled tubing through the tool and outwardly through various valves and ports in the tool to the wellbore itself. The tools also typically include one or more packer elements which act to isolate certain portions of the wellbore from each other. Such tools may be of any length but, for instance, for treatment of a particular interval in the wellbore, the tool must incorporate packer elements which, when positioned in the wellbore, effectively straddle and isolate that portion of the wellbore from the remaining portions, both above and below the zone of interest. Obviously, if the interval to be treated is particularly long, the treatment tool must be similarly of great length. Thus, tools of seventy-five feet in length or longer are not uncommon.

The injection of such a long-length tool which cannot be plastically deformed in the manner of coiled tubing and which is typically of a larger diameter than the coiled tubing itself such that it will not pass through the injector drive mechanism presents some difficulty. In order to overcome this difficulty, it has been common prior practice to mount the tool in what is effectively an extension of the well casing above the wellhead and positioning the injector drive mechanism on top of this pressurized cylindrical enclosure. Obviously, this places the bulky and heavy injector drive mechanism at an extreme height above the wellhead when long tools are to be used. Such weight cannot be supported solely by the cylindrical tool conduit and, therefore, must be at least partially supported by a heavy-duty crane or derrick in position over the wellhead. Despite employing guy-wires to steady the positioning of the top-heavy elevated drive mechanism, the uneven and irregular lateral forces applied to the assembly by unreeling and bending of the coiled tubing make such positioning difficult at best and an extreme safety hazard at worst.

U.S. Pat. No. 4,091,867, attempts to overcome these deficiencies by mounting the injector essentially at or near the surface and directing the coiled tubing upwardly to a high-mounted gooseneck and thereby into axial alignment with the wellbore. In this arrangement, the tubing must pass through a pressurized conduit for its entire length of travel from the injector head over the gooseneck to the wellhead. In such an arrangement, the gooseneck is placed above the highest point of a tool to be injected and, therefore, especially with long-length tools, the pressurized conduit extending from the injector head to the wellhead must be of long length with its associated problems of weight, pressurization and potential sealing failure. Additionally, the plastic deformation of the coiled tubing over the gooseneck is conducted with the tubing being in compression which can shorten tubing life when compared to plastic deformation in tension as is accomplished when the injector head is axially mounted above the wellbore and draws the coiled tubing over the gooseneck.

SUMMARY OF THE INVENTION

The present invention provides a method and apparatus whereby a tool of any length may be used in a coiled tubing operation and wherein the coiled tubing injector drive mechanism may be mounted directly on the wellhead.

In accordance with the invention, a well tool of any length is mounted within a closed-end, cylindrical lubricator which is then mounted on the wellhead. Upon establishment of fluid communication between the injector and the wellhead by opening of at least one wellhead valve, the tool is lowered from the lubricator into the wellbore with a portion of the tool remaining within the wellhead adjacent first seal rams located in the wellhead which are then closed to engage and seal around the tool. The lubricator is then removed and the injector head is positioned above the wellhead and the coiled tubing is extended to engage the captured tool and fluid communication is established between the coiled tubing and the tool. The injector drive mechanism is then connected to the wellhead and the first seal rams capturing the tool are released and fluid communication is established between the wellbore and the tubing injector drive head.

Further in accordance with the invention, the retrieval and removal of the coiled tubing and well service tool is effected by performing the above steps in reverse order.

It is therefore an object of this invention to provide a method whereby remote or elevated mounting of a coiled tubing injector with its attendant complexity and safety problems is voided.

It is yet another object of this invention to provide a method and means for mounting a coiled tubing injector drive mechanism directly on a wellhead while allowing the insertion into the well of a substantially ridged tool having a central bore regardless of the length of the tool.

BRIEF DESCRIPTION OF THE DRAWINGS

The invention will now be described in the more limited aspects of a preferred embodiment thereof and in conjunction with the accompanying drawings forming a part of this specification and which.

DETAILED DESCRIPTION OF THE PREFERRED EMBODIMENT AND THE DRAWINGS

Figure 1:
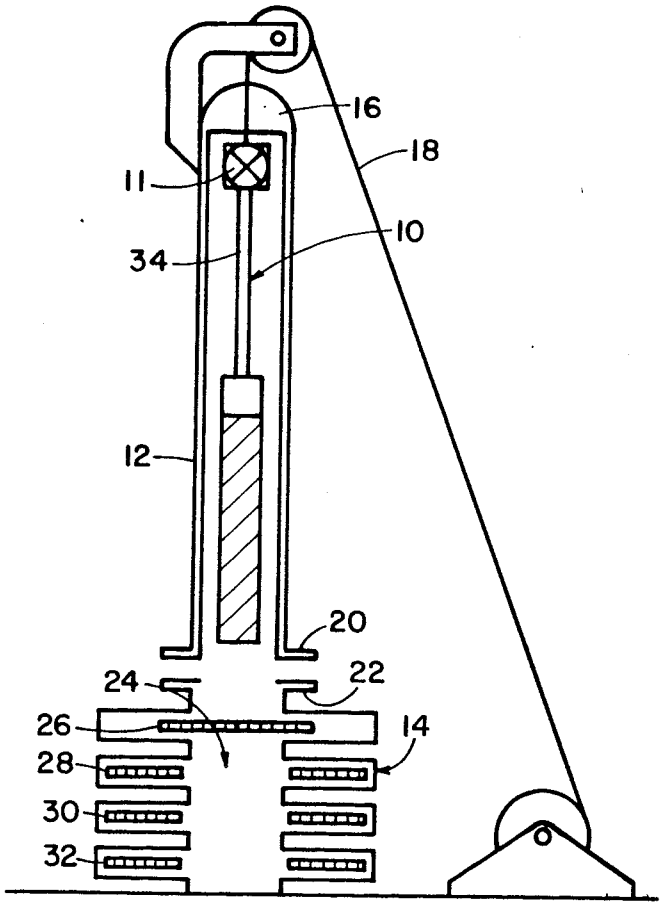
FIGS. 1–4 illustrate schematically and sequentially the steps in accordance with the present invention wherein a well service tool is positioned for insertion and inserted into a well, coiled tubing is attached to the service tool and the coiled tubing injector drive mechanism is mounted on the wellhead for use in running and retrieving the coiled tubing.

The invention will now be described in the more limited aspects of the preferred embodiment thereof including a description of parts and arrangements of parts. It will be understood that variations and deviations from the preferred embodiment may be undertaken while still being within the scope of the present invention.

The present invention allows for the insertion of a well service tool into the wellhead and retention of a portion of the service tool within the wellhead prior to the connection and mounting of the coiled tubing and coiled tubing injector drive mechanism directly on the wellhead.

In accordance with the invention, a well service tool of any length is initially mounted within a cylindrical lubricator tube long enough to contain the length of the tool and having one closed end through which a control cable is passed. The central bore of the well service tool includes a valve which, in its closed position, blocks pressurized fluid communication within the well service tool. In one preferred form of the invention, the valve comprises a manually operated ball valve. In another preferred embodiment, the valve is automatically opened when connected with coiled tubing such as through a quick-connect coupling. The opposite end of the lubricator tube includes mounting means for attaching the lubricator tube to a wellhead apparatus which includes a series of valves commonly referred to as a blow-out preventer (BOP) stack. Prior to mounting of the lubricator tube on the wellhead apparatus, the wellbore is sealed off by closing a valve commonly referred to as the blind rams of the BOP stack. The lubricator tube is then mounted on the wellhead and fluid communication between the wellbore and the lubricator is established by opening the blind rams.

Following mounting of the lubricator and opening the blind rams, the well service tool is lowered, using the control cable, into the wellbore to a point where at least a portion of the well service tool remains in the BOP stack. A pair of pipe slips in the BOP stack which are sized to engage the outer surface of the well service tool are then closed to clamp the well service tool in position. Pipe rams in the BOP stack are also closed into sealing engagement against the outer surface of the well service tool.

With the well service tool valve in the closed position, the lubricator can then be removed from the wellhead and the control cable detached. The coiled tubing and tubing injector drive mechanism can then be moved into position axially above the wellbore. As with the mounting of the lubricator/tool assembly, a relatively lightweight crane may be used for positioning the injector drive mechanism since crane support during operations is unnecessary. The coiled tubing is connected to the well service tool and the well service tool valve is opened either manually or automatically depending on its type to establish fluid communication from the wellbore through the tool to the coiled tubing. The coiled tubing injector drive mechanism can then be mounted on the wellhead and the pipe rams and pipe slips released from the tool and normal coiled tubing running and retrieval operations can then be conducted.

In removing the coiled tubing and the well service tool from the well, the operation is effected in reverse order. Thus, the well service tool is drawn up into the wellhead BOP stack. The pipe rams and pipe slips are then closed to engage and seal against the outer surface of the well service tool. The injector drive mechanism is then detached from the wellhead and the coiled tubing is disconnected from the well service tool with the closing of the well service tool bore valve. The control cable is then connected to the well service tool and the lubricator tube is mounted on the wellhead. With the release of the pipe ram and the pipe slips, the well service tool can be raised with the control cable into the lubricator and completely out of the wellbore. The blind rams of the BOP can then be closed off to seal the wellhead and the lubricator and tool removed therefrom.

One particular advantage of the process in accordance with the present invention is that pressure testing is possible and desirable throughout the procedure which greatly enhances the safety of the operation. Thus, the sealing of the lubricator attachment to the wellhead can be pressure-tested prior to the opening of the blind rams. Similarly, the sealing of the pipe rams against the well service tool can be tested prior to removal of the lubricator from the wellhead. Additionally, the pressure integrity of the coiled tubing and service tool connection can be tested as well as the pressure testing of the coiled tubing injector drive mechanism and its seal both against the wellhead and against the coiled tubing can be tested prior to opening of the pipe rams. It can also be clearly seen that pressure testing of the reverse order retrieval operation can be effected.

Referring now to the drawings wherein the showings are for purposes of illustrating a preferred embodiment of the invention only and not for the purpose of limiting same, FIG. 1 shows well service tool 10 having a central bore (not shown) and a valve 11 in the central bore which is initially in the closed position. The well service tool 10 is mounted in a lubricator tube 12 which is suspended above a wellhead 14 through the use of a crane (not shown). The lubricator tube 12 has a closed end 16 through which a control cable 18 passes through a slip seal arrangement in the closed end 16. The lubricator also includes mounting means such as a flange 20 which corresponds to a mating flange 22 of the wellhead apparatus 14. The wellbore 24 is sealed from fluid communication with the atmosphere by the closure of the blind rams 26 of the wellhead apparatus 14. The wellhead apparatus also includes shear rams 28, pipe rams 30 and slip rams 32. Pipe rams 30 are adapted to effect a seal against the outer surface of a necked-down stinger 34 of the well service tool 10 and/or the coiled tubing during operation. Similarly, the slip rams 32 are sized to clamp against the outer surface of the stinger 34 of the service tool and/or the coiled tubing.

Figure 2:
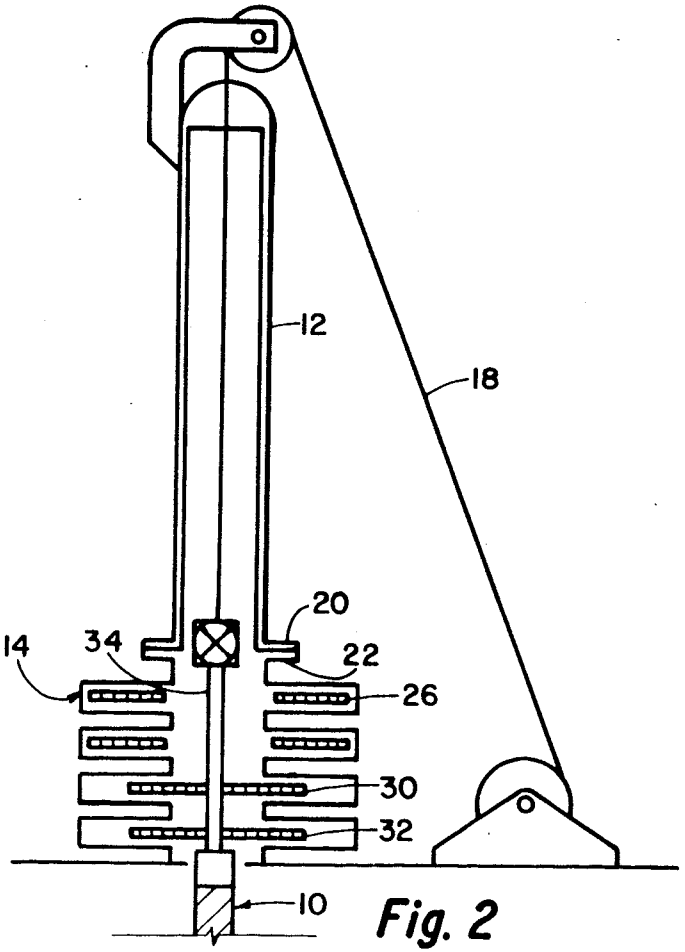

FIG. 2 illustrates the step of the process of inserting the well service tool into the well following connection and sealing engagement between the flange 20 of the lubricator tube and the mating flange 22 of the wellhead apparatus 14 and the opening of the blind rams 26. As stated previously, pressure testing of the seal between the lubricant 12 and the wellhead apparatus 14 prior to the opening of the blind rams 26. The well service tool 10 is lowered into the wellbore 24 on the control cable 18 to a predetermined distance such that the stinger 34 of the well service tool 10 is located within the wellhead apparatus 14. The pipe rams 30 and pipe slips 32 are shown in the closed position against the outer surface of the stinger 34 of the well service tool 10. In accordance with a preferred embodiment of the invention as shown in the drawings, the stinger 34 has the same outer diameter as the coiled tubing to be used. Thus, the pipe rams 30 and the pipe slips 32 are sized to engage both the well service tool 10 at the stinger 34 and the coiled tubing in use. It will be understood that additional pipe rams and pipe slips may be incorporated into the wellhead apparatus 14 having a different (larger) sizing so that clamping and sealing by the pipe slips and pipe rams, respectively, can be effected against a well service tool 10 having an overall larger diameter than the coiled tubing. Once clamping of the well service tool 10 within the wellhead apparatus 14 has been effected by the pipe slips 32 and sealing has been effected by the pipe rams 30 against the outer surface of the well service tool 10, the lubricator 12 can be removed from the wellhead apparatus 14 and the control cable 18 can be disconnected from the well service tool 10.

Figure 4:
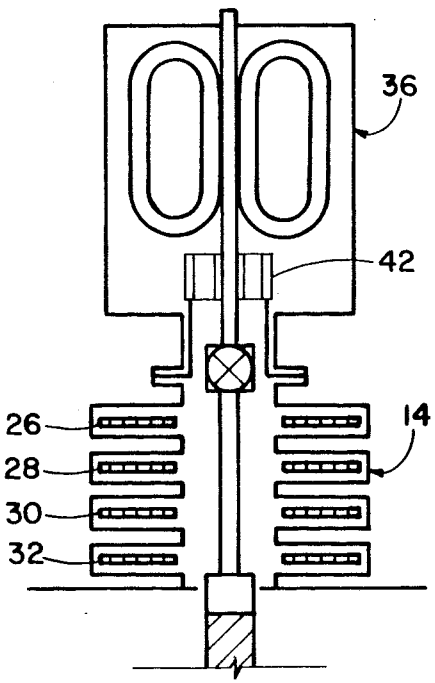
Figure 3:
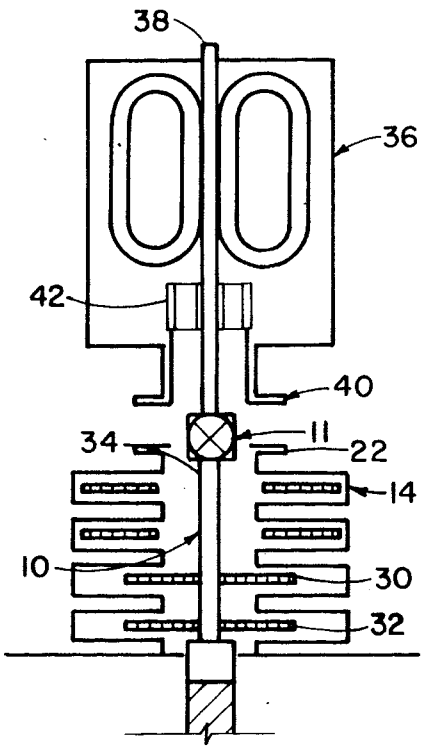

FIG. 3 shows the coiled tubing injector drive mechanism 36 suspended axially above the wellhead apparatus 14 and the coiled tubing 38 extending therethrough and connected to the well service tool 10. The well service tool valve 11 is then opened and fluid communication between the coiled tubing and the inner bore of the well service tool 10 is effected. The injector drive mechanism 36 can then be connected to the wellhead apparatus 14 by connecting the flange 40 to the mating flange 22. Following pressure testing of the connection of these flanges, all pipe rams and slips can be opened and normal coiled tubing operations carried out with the coiled tubing injector mechanism 36 mounted directly on the wellhead apparatus 14 (FIG. 4).

Figure 5:
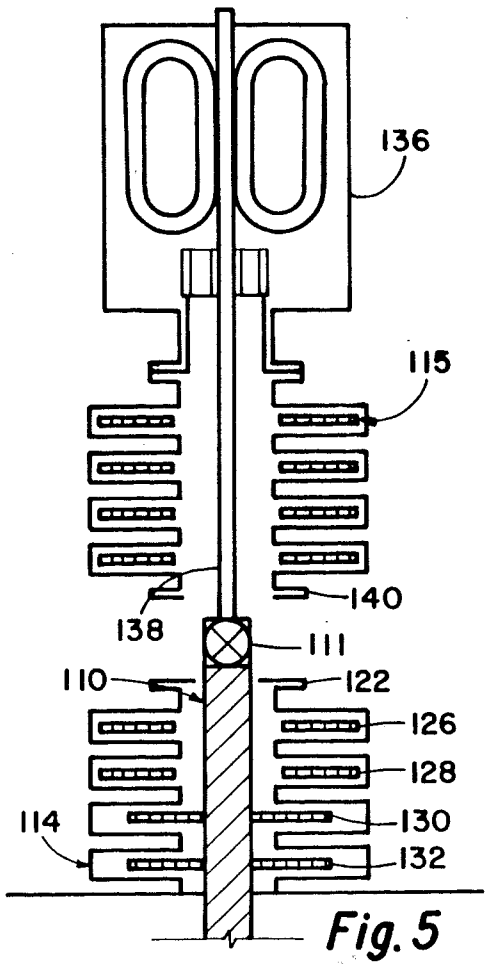
FIG. 5 illustrates an alternative embodiment of the invention.

FIG. 5 illustrates an alternative embodiment of the process of this invention wherein the only deviation from the previously described process is illustrated. Thus, FIG. 5 corresponds generally to FIG. 3 of the previously described process. As can be seen in FIG. 5, a well service tool 110 has been positioned within a wellhead apparatus 114 in a manner similar to that shown in FIG. 3. Where the illustration of FIG. 5 deviates from that of FIG. 3 is that the well service tool 110 does not incorporate a necked down stinger 34 as shown in FIG. 3. For this reason, the pipe rams 130 and the pipe slips 132 are sized to accommodate the larger diameter of the well service tool 110. Because the pipe rams 130 and pipe slips 132 are not properly sized for accommodation of coiled tubing 138 having a smaller diameter than the well service tool 110, a second BOP stack 115 is employed. Following the connection of the coiled tubing 138 to the well service tool 110, the valve 111 can be opened and the coiled tubing injector drive mechanism 136 and the BOP stack 115 can be connected through flanges 140 and 122 in the manner described with respect to the earlier embodiment. While FIG. 5 illustrates the BOP stack 115 being connected to the injector drive mechanism 136, it will be understood and considered within the scope of this invention that the BOP stack 115 could be directly mounted above the pipe rams 130 and pipe slips 132 at an earlier point in the process with the later connection of the coiled tubing 138 and the injector drive mechanism 136 being effected above the BOP stack 115. Additionally, although the wellhead apparatus 114 has been shown including blind rams 126 and shear rams 128, it would not be necessary to duplicate these rams in one of the wellhead apparatus 115 or the BOP stack 115.

As stated previously, the withdrawal of the coiled tubing and well service tool from the well can be easily effected by a direct reversal of the above-described installation process.

While the invention has been described in the more limited aspects of a preferred embodiment thereof, other embodiments have been suggested and still others will occur to those skilled in the art upon a reading and understanding of the foregoing specification. It is intended that all such embodiments be included within the scope of this invention as limited only by the appended claims.

I claim:

1. A method of inserting a well service tool into a wellbore having a wellbore axis, the well service tool having a central bore and a valve within the bore comprising the sequential steps of:

(a) inserting the well service tool into a lubricator having a closed first end portion with a control cable extending therethrough and connected to the well service tool and a second open end portion incorporating means for connecting the lubricator to a wellhead;

(b) axially aligning the well service tool and the lubricator along the axis and connecting the lubricator to the wellhead;

(c) inserting at least a portion of the well service tool into the wellbore so that a portion of the tool is adjacent at least one pair of pipe rams in the wellhead;

(d) closing the pipe rams against an outer surface of the well service tool to hold the well service tool in position and effect a fluid-tight seal against the tool within the wellbore, and (e) removing the lubricator from the wellhead and disconnecting the control cable from the well service tool.

2. The method as set forth in claim 1 further including the steps of:

(f) connecting coiled tubing to the well service tool;

(g) opening the well service tool bore valve;

(h) attaching a coiled tubing drive mechanism to the wellhead, and (i) releasing the pipe rams from the well service tool whereby normal coiled tubing running, treatment and retrieving operations may proceed.

3. The method as set forth in claim 2 further including the step of pressure testing following at least one of steps (b), (d), (g) and (h).

4. The method as set forth in claim 1 further including the step of setting a pair of pipe slips within the wellhead against the other surface of the well service tool following said step (c) whereby said pipe slips act in conjunction with said pipe rams to hold said well service tool in position with said wellhead and wellbore.

5. A method of retrieving the well service tool from the wellbore, the method comprising carrying out the steps as set forth in claim 2 in reverse order.

* * * * *